US005682773A

United States Patent [19]

Soucie

[11] Patent Number: 5,682,773

[45] Date of Patent: Nov. 4, 1997

[54] APPARATUS FOR IMPROVING ATMOSPHERIC DYE MACHINES

[76] Inventor: Donald P. Soucie, 55 Walnut Hill Rd., Pascoag, R.I. 02859

[21] Appl. No.: 711,601

[22] Filed: Sep. 10, 1996

Related U.S. Application Data

[62] Division of Ser. No. 517,292, Aug. 21, 1995.

[51] Int. Cl.[6] ..... D06B 3/10; D06B 23/14

[52] U.S. Cl. ..... 68/15; 68/183

[58] Field of Search ..... 68/15, 183; 134/102.1, 134/102.2, 105; 122/31.1

[56] References Cited

U.S. PATENT DOCUMENTS

| | | | |
|---|---|---|---|
| 3,218,833 | 11/1965 | Booth | 68/15 X |
| 3,593,545 | 7/1971 | Blumenkamp | 68/15 |
| 4,697,291 | 10/1987 | Shepherd et al. | 68/183 X |

FOREIGN PATENT DOCUMENTS

| | | | |
|---|---|---|---|
| 661018 | 2/1929 | France | 68/183 |

*Primary Examiner*—Philip R. Coe

*Attorney, Agent, or Firm*—Scott B. Garrison; Gary E. Lambert

[57] ABSTRACT

A modification to atmospheric dye machines, in which the modification increases the attainable operating temperatures to a level in which polyester textiles can be successfully dyed. The modification is accomplished by relocating steam injection to a location which takes advantage of venturi principles and harnesses the slight pressurization obtained by injecting steam into the liquor. The combination increases circulation of dye liquor, convective heat transfer and minimizes the formation of isothermal layering of the dye liquor. Dye liquor subject to reheating is drawn from the tank bottom, further decreasing the amounts of cooler dye liquor which may still collect within the tank.

4 Claims, 1 Drawing Sheet

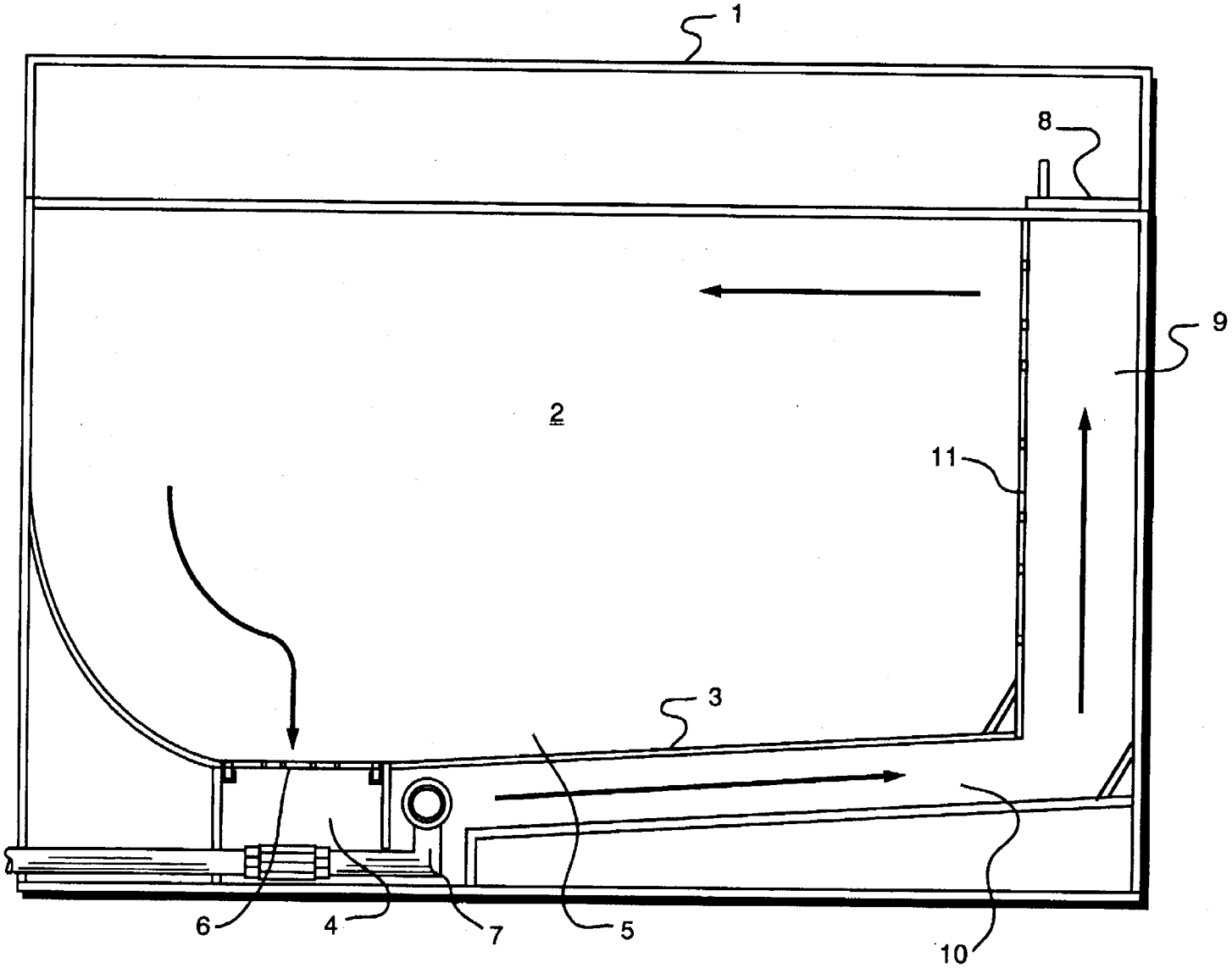
1
2
3
4
5
6
7
8
9
10
11

APPARATUS FOR IMPROVING ATMOSPHERIC DYE MACHINES

CROSS REFERENCE TO RELATED APPLICATIONS

This application claims the benefit in the form of a divisional application under 37 CFR 1.53(b)(1) of currently pending parent application Ser. No. 08/517,292 filed Aug. 21, 1995, pending by the same inventor.

BACKGROUND OF THE INVENTION

The present invention relates to the textile industry. More particularly it relates to an improvement in a typical atmospheric dye machine. This improvement provides an atmospheric dye machine with the capability to attain and maintain higher temperatures which are otherwise not achievable.

A typical unmodified atmospheric dye machine contains a quantity of water, dye and some quantity of carrier agent. The liquor resulting from mixing these ingredients is heated typically by steam to the requisite temperature needed for the specific dye operation. A textile is mechanically conveyed through the heated liquor continuously until completion of the dying process.

The prior art machines which operate at atmospheric pressures are limited by the operating temperatures which they can maintain. An unmodified machine can reach temperatures of 195 degrees F. in the liquor bath. This temperature has proven to be the limit of such machines. To successfully dye polyester however, a threshold of 208 degrees F. is required. An unmodified atmospheric dye machine cannot attain temperatures in this range.

Modification of an atmospheric dyebeck to include a heat exchanger and a recirculation pump typically allow the operator to achieve temperatures as high as 206 degrees F. in the liquor bath, and the applicant is aware of a few rare instances when temperatures as high as 208 degrees F. have been reached. However, the problem with this modification is that the temperature is limited by the onset of pump cavitation which occurs at these temperatures. Although 208 degrees F. is theoretically possible, if this temperature were achieved it could not be maintained without the cavitation burning up the pump.

Until now, the only viable method which could successfully dye polyesters was to use a pressurized dye machine. Through the operation of pressure, higher temperatures could be maintained within the liquor bath and polyesters could be properly dyed. However, the cost to purchase pressurized dying equipment and the cost to operate the same is expensive and therefore prohibitive to the smaller company.

The present invention overcomes the deficiencies found with atmospheric dye machines and provides the industry with an alternative to investing in a pressurized system. Use of the present invention allows an operator to achieve maintainable temperatures of 211 to 212 degrees F. at sea level under atmospheric conditions. The present invention makes use of convection, natural circulation, and pressure differentials to eliminate the deficiencies found in the prior art systems. It also provides the public with an invention readily adaptable to existing dye machinery thereby making it cost effective for the owner to modify and operate this existing machinery at the higher temperatures needed to dye polyesters.

Additional advantages which have proven to be inherent to the present invention are that the present invention can use non-toxic, biodegradable dye carders, the quantity of dye necessary for satisfactory results is less than prior art devices, and the production time has been reduced to approximately one-tenth of its former time of 24 hours. The reduction in production time alone provides the dyer with a great deal of time and energy savings.

SUMMARY OF THE INVENTION

It is therefore an object of this invention to provide an apparatus capable of adaptation to an atmospheric dye system which enables the dye bath temperature to exceed the temperature threshold which can otherwise be achieved.

It is another object of the present invention to provide an apparatus that utilizes convection, natural circulation and pressure differentials to realize this higher heat potential.

It is still another object of the present invention to provide an apparatus that does not necessitate the use of pressure to adequately dye polyesters.

Yet another object of this invention is to provide an apparatus that dyes a textile in substantially less time than otherwise achievable by either atmospheric or pressurization of the system.

Still another object of this invention is to provide an apparatus that because it operates more efficiently, uses less energy, water, and dye than the prior an machines.

Still another object of this invention is to provide an apparatus that can utilize non-toxic environmentally safe chemicals-to dye the textiles.

BRIEF DESCRIPTION OF THE DRAWING

The above mentioned and other objects and features of this invention and the manner of attaining them will become apparent, and the invention itself will be best understood by reference to the following description of the embodiment of the invention in conjunction with the accompanying drawings wherein the Figure is a side elevation of a typical atmospheric dye machine modified to depict the elements specific to the present invention.

DETAILED DESCRIPTION OF A PREFERRED EMBODIMENT

Referring now to the Figure, a dye machine containing the preferred embodiment of the present invention is designated generally by the numeral 1. The present invention operates on the same general principles that all atmospheric dye machines use. That is, a liquor bath 2 consisting of a mix of dye, water, and other chemicals is added to the machine 1; and the temperature of bath 2 is raised to the level mandated by a textile undergoing the procedure. The textile is then spooled or otherwise drawn continuously through the heated liquor bath until completion of the dying process.

Adaptation of an atmospheric dye machine to encompass the present invention requires the addition of a sloped bottom 3, addition of a two chambered well 4 in the bottom of tank 5, a perforated well cover 6 leading to well 4, relocation of sparge tube 7 to well 4, and a chamber cover 8 over chamber 9.

The present invention operates under the principle of injecting steam through sparge tube 7 directly into the liquor that has settled into well 4. The perforations of well cover 6 allow the cooler liquor in bath 2 to drain through well cover 6 and collect in well 4, well cover 6 also serves to cover and isolate the liquor contained within well 4 thereby minimizing the impact convective currents otherwise would have upon the liquor contained within well 4 if it were completely open to bath 2.

The construction of well 4 creates two chambers, each open along the bottom to the other, but where the top of one chamber is open solely to tank 5 via well cover 6, the top of the other chamber is open solely to the bottom of spout 10. The steam outlet of sparge tube 7 is located at the top of the spout side chamber of well 4. Location on the spout side of well 4 is important because it provides the steam with a path of least resistance up along spout 10, and prevents the steam from merely bubbling into tank 5 through well cover 6. As the steam and liquor from the well mix, the steam transfers its heat to the liquor and together they progress up sloped bottom 3 along spout 10 thence into chamber 9. Upward movement of the now heated liquor is accomplished primarily by the venturi effect created by the steam being injected and expanding in the liquor within the well, and progressing up along the spout.

Chamber 9 has a hinged chamber cover 8 which serves two important functions; first, by collecting the higher temperature liquor sent to chamber 9 and eliminating any escape path other than through baffle 11, chamber 9 is maintained at a slightly higher pressure relative to tank 5. This higher pressure serves to force the liquor through baffle 11 thereby increasing the rate of circulation and improving convection heat transfer throughout the tank. The second function that chamber cover 8 accomplishes is that it minimizes heat loss to the atmosphere of tank 5 prior to mixing this hotter liquor with the liquor within the tank.

Homogeneous temperatures of 211 to 212 degrees F. are reached by the intermixing of the hotter liquor with the colder liquor accomplished primarily by the increased convective action resulting from the liquor being forced at a slightly higher pressure through baffle 11. However, the higher apparent specific gravity of the colder liquor settling into the well where it is then heated by the steam and reintroduced at a higher temperature into the bath; plus the mechanical mixing resulting from the action of the textile being moved through the bath; also play a role in the homogeneous mixture of heated liquor.

It is to be understood the present invention is not restricted to the above-described embodiment, but may be varied within the scope of the appended claims. Since numerous modifications and changes will readily occur to those skilled in the art, accordingly all such modifications and equivalents which fall within the scope of the claims may be resorted to.

I claim:

1. An improved atmospheric dye machine of the type in which a textile is mechanically advanced through a tank containing a dye liquor bath heated by injecting steam through a sparge tube located in a chamber separated from the tank by a baffle, and in which the baffle allows the heated dye liquor to intermingle in the tank with the remaining liquor contained within the tank for a period of time and at a temperature conducive to dyeing certain textiles, wherein the improvement comprises:

a well, placed at a low point of the tank to collect cooler dye liquor settling to the bottom of said tank resulting from natural separation of dye liquor into isothermal layers based on relative densities of said dye liquor;

a well cover, placed between said well and said tank, said well cover capable of allowing said liquor in said tank to pass through said well cover and collect in said well;

a spout, for connecting said chamber to said well;

a chamber cover placed over said chamber capable of sealing the top of said chamber to tank atmosphere; and a sparge tube located at said spout end of said well, for discharge of steam to provide both a positive pressure build up in said chamber and to create a suction draw on the liquor in said well.

2. An apparatus as claimed in claim 1, wherein the introduction of steam and the subsequent circulation of dye liquor throughout said apparatus enable the maintenance of temperatures in excess of 195 degrees F.

3. An apparatus as claimed in claim 2 capable of dyeing polyester textiles.

4. An apparatus as claimed in claim 3, capable of sustaining temperatures between 211 and 212 degrees F.

* * * * *